US007531246B2

(12) United States Patent
Chen

(10) Patent No.: US 7,531,246 B2
(45) Date of Patent: May 12, 2009

(54) CORE INSERT AND METHOD FOR MANUFACTURING THE SAME

(75) Inventor: Ga-Lane Chen, Santa Clara, CA (US)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 216 days.

(21) Appl. No.: 11/309,671

(22) Filed: Sep. 8, 2006

(65) Prior Publication Data

US 2007/0141383 A1 Jun. 21, 2007

(30) Foreign Application Priority Data

Dec. 15, 2005 (CN) ..... 2005 1 0120726

(51) Int. Cl.
*B32B 15/04* (2006.01)
*B05D 7/14* (2006.01)

(52) U.S. Cl. ..... 428/627; 428/634; 427/405; 427/438; 427/419.7

(58) Field of Classification Search ..... 249/79; 264/328.16; 428/680, 666, 667, 634, 215, 428/216, 220, 332, 334, 335, 336, 457, 408, 428/704; 427/135, 294, 295, 327, 328, 404, 427/405, 419.7, 437, 438; 204/192.1, 192.15, 204/192.16

See application file for complete search history.

(56) References Cited

U.S. PATENT DOCUMENTS

| | | | | |
|---|---|---|---|---|
| 5,744,173 | A | 4/1998 | Sterett | |
| 6,197,438 | B1 * | 3/2001 | Faulkner | 428/627 |
| 6,749,787 | B2 * | 6/2004 | Mastro et al. | 264/219 |
| 2007/0148462 | A1 * | 6/2007 | Hsiao et al. | 428/408 |

* cited by examiner

*Primary Examiner*—John J Zimmerman
(74) *Attorney, Agent, or Firm*—Andrew C. Cheng

(57) ABSTRACT

An exemplary core insert includes a main body having a central protruding portion and a peripheral flange portion surrounding the central protruding portion, and a multilayer film formed on the central protruding portion. The multilayer film includes a nickel-phosphorus layer formed on the central protruding portion, a chromium layer formed on the nickel-phosphorus layer, a chromium nitride layer formed on the chromium layer, and a diamond-like carbon layer formed on the chromium nitride layer. The core insert has excellent hardness, good corrosion resistance, good wear resistance, high adhesion, and a long operational lifetime.

20 Claims, 4 Drawing Sheets

CORE INSERT AND METHOD FOR MANUFACTURING THE SAME

TECHNICAL FIELD

The present invention generally relates to mold cores, and more particularly to a core insert of a mold core. The present invention also relates to a method for manufacturing the core insert.

BACKGROUND

At present, molds are widely used for manufacturing glass optical articles, plastic articles, industrial parts, etc. With the development of the digital cameras, video recorders, compact disc players, their construction articles and glass optical articles are in increasing demand. Generally, these construction articles and glass optical articles are made through a direct press-molding process or an injection-molding process.

A core insert is one of the most important parts of a mold. During the press-molding process or the injection-molding process, the raw material is likely to directly adhere to a molding surface of the core insert, so it is necessary for the core insert to have characteristics such as excellent hardness, good heat resistance and wear resistance, etc.

Several criteria that should be considered in making the core insert are listed below:

(1) the core insert formed should be rigid and hard enough so that the mold cannot be damaged by scratching and can withstand high temperatures;

(2) the core insert formed should be highly resistant to deformation or cracking even after repeated heat shock;

(3) the core insert formed should not react with or adhere to the raw material at high temperatures;

(4) the material of the core insert should be highly resistant to oxidization at high temperatures;

(5) the core insert formed should have good machinability, high precision, and a smooth molding surface; and (6) the manufacturing process using the core insert should be cost-effective.

Referring to FIG. 4, a typical core insert 10 is shown. The core insert 10 only includes a block. The block defines a smooth molding surface 12 and a number of sidewalls 14 adjacent to the molding surface 12. However, after long time reduplicative molding process, the smooth molding surface 12 is likely to become abraded and corroded. The worst abrasion occurs on or near joins between the molding surface 12 and the sidewalls 14. Thus, the ability of the core insert 10 to produce precision products decreases over time.

What is needed, therefore, is a core insert with good corrosion resistance, good wear resistance, and a method for manufacturing the core insert.

SUMMARY

One embodiment provides a core insert. The core insert includes a main body having a central protruding portion and a peripheral flange portion surrounding the central protruding portion, and a multilayer film formed on the central protruding portion. The multilayer film comprising a nickel-phosphorus layer formed on the central protruding portion, a chromium layer formed on the nickel-phosphorus layer, a chromium nitride layer formed on the chromium layer, and a diamond-like carbon layer formed on the chromium nitride layer.

Another embodiment provides a method for manufacturing a core insert. The method includes the steps of: providing a main body comprising a central protruding portion and a peripheral flange portion surrounding the central protruding portion; forming a nickel-phosphorus layer on the central protruding portion; forming a chromium layer on the nickel-phosphorus layer; forming a chromium nitride layer on the chromium layer; and forming a diamond-like carbon layer on the chromium nitride layer.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present method. Moreover, in the drawings, like reference numerals designate corresponding parts throughout the several views.

DETAILED DESCRIPTION OF PREFERRED EMBODIMENTS

Embodiments will now be described in detail below and with reference to the drawings.

Figure 1:
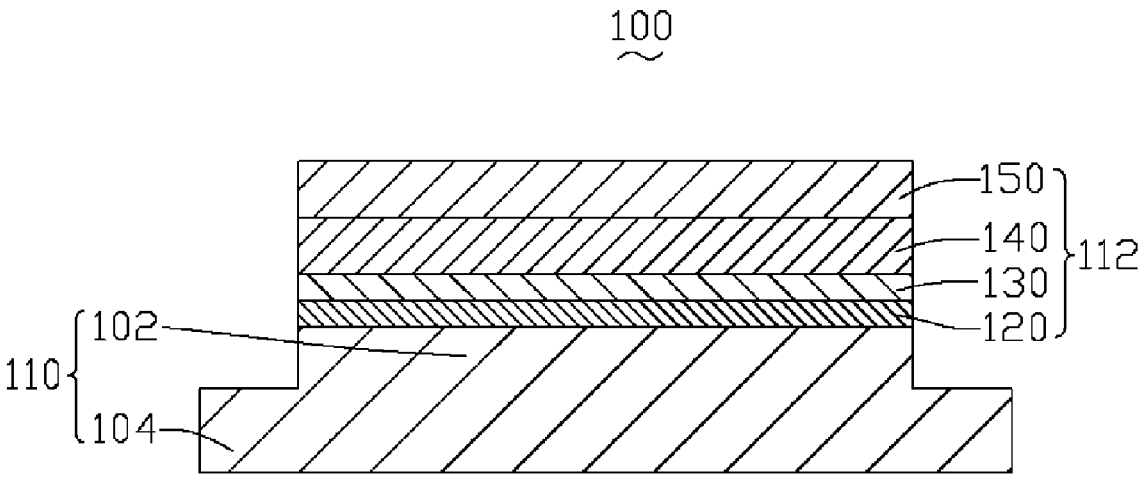
FIG. 1 is schematic, cross-sectional view of a core insert in accordance with a first preferred embodiment.

Referring to FIG. 1, a core insert 100 according to a first exemplary embodiment is shown. The core insert 100 includes a main body 110 and a multilayer film 112 formed on the main body 110 and entirely covers the central protruding portion 102.

The main body 110 defines a central protruding portion 102 and a peripheral flange portion 104 surrounding the central protruding portion 102. The central protruding portion 102 is thicker than the peripheral flange portion 104, and protrudes from the surface as a result. The central protruding portion 102 is used to contact with articles to be produced and has a molding surface with a shape conforming to that of the articles to be produced. The peripheral flange portion 104 can be used to protect the central protruding portion 102, thereby preventing the central protruding portion 102 from abrasion and corrosion during the molding process.

The main body 110 is generally a mirror-polished mold steel. The surface roughness (Ra) of the main body 110 is less than 10 nanometers. The main body 110 can be made of a mold steel selected from a group consisting of iron-carbon-chromium (Fe—C—Cr) alloy, iron-carbon-chromium-molybdenum (Fe—C—Cr—Mo) alloy, iron-carbon-chromium-silicon (Fe—C—Cr—Si) alloy, iron-carbon-chromium-molybdenum-nickel (Fe—C—Cr—Mo—Ni) alloy, iron-carbon-chromium-nickel-titanium (Fe—C—Cr—Ni—Ti) alloy, iron-carbon-chromium-tungsten-manganese (Fe—C—Cr—W—Mn) alloy, iron-carbon-chromium-tungsten-vanadium (Fe—C—Cr—W—V) alloy, iron-carbon-chromium-molybdenum-vanadium (Fe—C—Cr—Mo—V) alloy, and iron-carbon-chromium-molybdenum-vanadium-silicon (Fe—C—Cr—Mo—V—Si) alloy.

The multilayer film 112 is formed on the main body 110. In the preferred embodiment, the multilayer film 112 is formed on the central protruding portion 102. The multilayer film 112 includes a nickel-phosphorus layer 120, a chromium layer 130, a chromium nitride layer 140, and a diamond-like carbon layer 150.

The nickel-phosphorus layer 120 serves as a protective layer and formed on the surface of the central protruding portion 102. The nickel-phosphorus layer 120 has good adhesion to the central protruding portion 102. The nickel-phosphorus layer 120 can have a thickness in a range from 1 micron to 30 microns. Preferably, the nickel-phosphorus layer 120 can have a thickness in a range from 5 microns to 20 microns.

The chromium layer 130 is formed on the nickel-phosphorus layer 120. The chromium layer 130 serves as an adhesive layer to enhance the adhesion of the multilayer film 112. Meanwhile, chromium has low reactivity, so the chromium layer 130 also plays a role in resisting corrosion. The chromium layer 130 can have a thickness in a range from 50 nanometers to 500 nanometers. Preferably, the chromium layer 130 can have a thickness in a range from 100 nanometers to 300 nanometers.

The chromium nitride layer 140 is formed on the chromium layer 130. The chromium nitride layer 140 serves as an intermediate layer for further enhancing the adhesion of the multilayer film 112. The chromium nitride layer 140 can have a thickness in a range from 100 nanometers to 2000 nanometers. Preferably, the chromium nitride layer 140 can have a thickness in a range from 500 nanometers to 1500 nanometers.

The diamond-like carbon layer 150 is formed on the chromium nitride layer 140. The diamond-like carbon layer 150 is an outermost layer of the multilayer film 112 and contacts an article to be produced. The diamond-like carbon layer 150 can be an amorphous hydrogenated carbon layer. The diamond-like carbon layer 150 should have excellent properties such as hardness, smoothness, corrosion resistance and wear resistance, etc. A thickness of the diamond-like carbon layer 150 can be in a range from 100 nanometers to 3000 nanometers. Preferably, the thickness of the diamond-like carbon layer 150 can be in a range from 300 nanometers to 1000 nanometers.

The multilayer film 112 should have good corrosion resistance, good wear resistance and high adhesion to the main body 110. The multilayer film 112 can serve as thin protective film on the central protruding portion 102 of the core insert 100.

Figure 2:
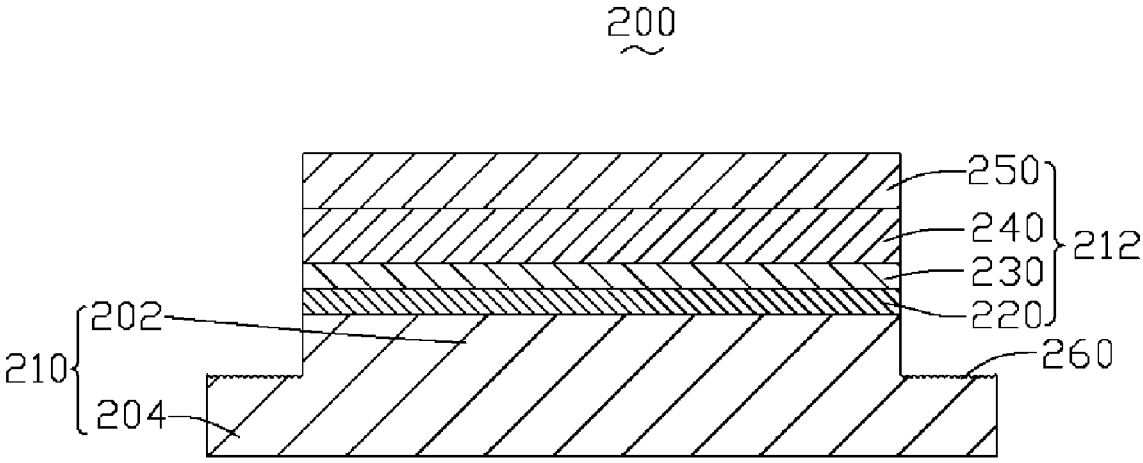
FIG. 2 is a schematic, cross-sectional view of a core insert in accordance with a second preferred embodiment.

Referring to FIG. 2, a core insert 200 according to a second exemplary embodiment is shown. The core insert 200 includes a main body 210 and a multilayer film 212 formed on the main body 210.

In the illustrated exemplary embodiment, the main body 210 defines a central protruding portion 202 and a peripheral flange portion 204 around the central protruding portion 202. The main body 210 is similar to the main body 110 in the first preferred embodiment. The material and structure of the multilayer film 212 is similar to that of the multilayer film 112 in the foregoing embodiment. The multilayer film 212 is formed on the surface of the central protruding portion 202. The multilayer film 212 includes a nickel-phosphorus layer 220, a chromium layer 230, a chromium nitride layer 240, and a diamond-like carbon layer 250 stacked one on top of the other in that order. In this embodiment, a plurality of grooves 260 is formed on the surface of the peripheral flange portion 204. The peripheral flange portion 204 with the grooves 260 also can protect the central protruding portion 102, thereby preventing abrasion and corrosion of the central protruding portion 102 during molding process.

Figure 3:
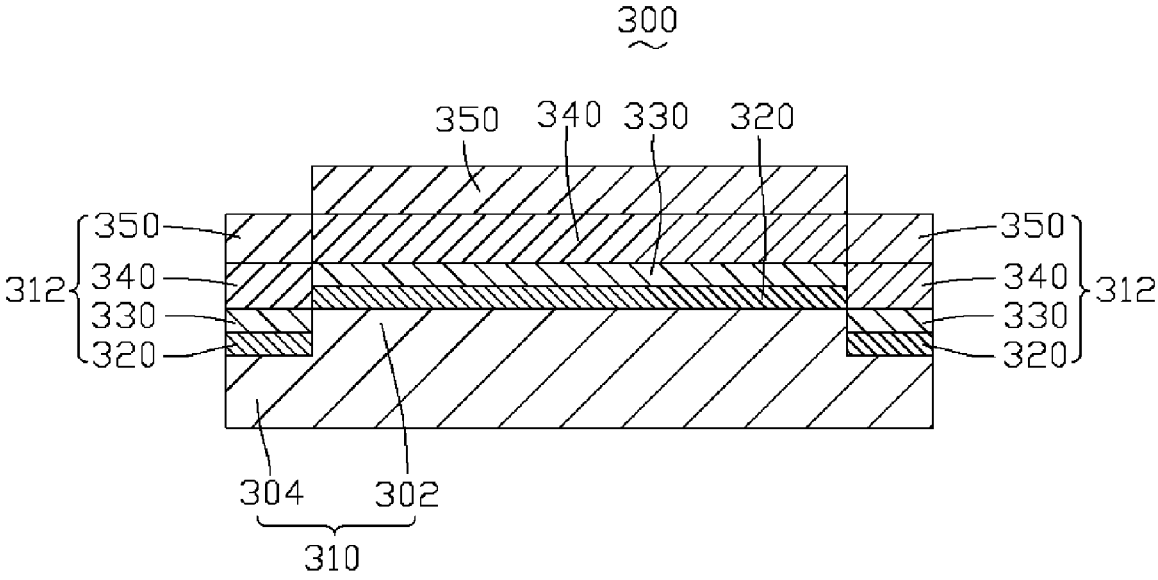
FIG. 3 is a schematic, cross-sectional view of a core insert in accordance with a third preferred embodiment.
Figure 4:
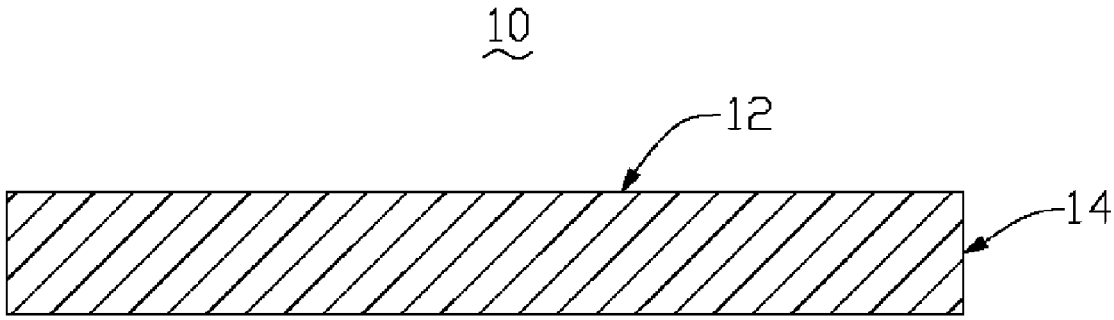
FIG. 4 (RELATED ART)
FIG. 4 is a schematic, cross-sectional view of a typical core insert.

Referring to FIG. 3, a core insert 300 according to a third exemplary embodiment is shown. The core insert 300 includes a main body 310 and a multilayer film 312 formed on the main body 310.

In the third embodiment, the main body 310 defines a central protruding portion 302 and a peripheral flange portion 304 around the central protruding portion 302. The main body 310 is also similar to the main body 110 in the first preferred embodiment. The material and structure of the multilayer film 312 is also similar to that of the multilayer film 112 in the first preferred embodiment. The multilayer film 312 includes a nickel-phosphorus layer 320, a chromium layer 330, a chromium nitride layer 340, and a diamond-like carbon layer 350 stacked in that order. In this embodiment the multilayer film 312 is not only formed on the surface of the central protruding portion 302, but also formed on the surface of the peripheral flange portion 304. Thus, the central protruding portion 302 can be entirely covered by the multilayer film 312.

A method for manufacturing the core insert 100 includes steps of:

step 1: providing a main body 110 comprising a central protruding portion 102 and a peripheral flange portion 104 surrounding the central protruding portion 102; and step 2: forming a nickel-phosphorus layer 120 on the central protruding portion 102;

step 3: forming a chromium layer 130 on the nickel-phosphorus layer 120;

step 4: forming a chromium nitride layer 140 on the chromium layer 130; and step 5: forming a diamond-like carbon layer 150 on the chromium nitride layer 140.

In step 1, the main body 110 is provided. The main body 110 has a central protruding portion 102 and a peripheral flange portion 104 surrounding the central protruding portion 102. The central protruding portion 102 is thicker than the peripheral flange portion 104, so that the central protruding portion 102 protrudes. The main body 110 can be made of a mold steel material.

In step 2, the nickel-phosphorus layer 120 is formed on the surface of the central protruding portion 102. Before forming the nickel-phosphorus layer 120 on the surface of the central protruding portion 102, a mask with a shape conforming to the peripheral flange portion 104 can be used to cover the peripheral flange portion 104 to protect the peripheral flange portion 104. The nickel-phosphorus layer 120 is then formed on the surface of the central protruding portion 102 using an electroless plating process. The electroless plating process is a plating process without an external current source. The plating operation is deposited by the catalytic reduction of nickel ions with sodium hypophosphite in acid baths on the surface being plated. The nickel-phosphorus compound contains typically 3 to 13% phosphorus by weight. The phosphorus content significantly influences its chemical and physical properties.

In step 3, 4 and 5, the chromium layer 130, the chromium nitride layer 140, and the diamond-like carbon layer 150 are formed one on top of the other using a sputtering process. The chromium layer 130, the chromium nitride layer 140 and the diamond-like carbon layer 150 can all be formed using a method such as direct current (DC) magnetron sputtering, alternating current (AC) magnetron sputtering, and radio frequency (RF) magnetron sputtering.

If the diamond-like carbon layer 150 is formed using an alternating current reactive magnetron sputtering process, the alternating current frequency can be in a range from 20 kilohertz (KHz) to 600 KHz. Preferably, the alternating current frequency can be in a range from 40 KHz to 400 KHz. If the diamond-like carbon layer 150 is formed using radio frequency reactive magnetron sputtering reactive magnetron sputtering process, the radio frequency can be 13.56 megahertz (MHz). During radio frequency magnetron sputtering, the target and cathode are connected with a matching network. With inductors and capacitors within the matching network, the forward power from the radio frequency power supply can be tuned and maximized so that the reflecting power is minimized.

The sputtering gas can be selected from a group consisting of a mixture of gas A and gas B. Gas A is hydrogen-containing gas such as methane, hydrogen and ethane. Gas B is an inert gas such as argon and krypton. A percentage ratio of gas A to gas B can be in a range from 3% to 40%. Preferably, the percentage ratio of gas A to gas B can be in a range from 5% to 20%.

After these steps, a multilayer film 112 with good corrosion resistance, good wear resistance and high adhesion to the main body 110 can be formed.

Additionally, in order to gain a uniform multilayer film 112, the main body 110 can be rotated at a speed in a range from 10 to 200 revolutions per minute (rpm). Preferably, the rotation speed of the main body 110 can be in a range from 20 to 80 rpm.

A method for manufacturing the core insert 200 is similar to the method for manufacturing the core insert 100. However, the method for manufacturing the core insert 200 further includes a step of forming a lot of grooves 260 on the surface of the peripheral flange portion 204.

A method for manufacturing the core insert 300 is also similar to the method for manufacturing the core insert 100. However, the method for manufacturing the core insert 300 further includes a step of forming a multilayer film 312 on the surface of the peripheral flange portion 304. In the method, the multilayer film 312 can firstly be formed on the central protruding portion 302, whilst a mask with a shape conforming to the peripheral flange portion 304 is used to cover the peripheral flange portion 304 to protect the peripheral flange portion 304. Then the multilayer film 312 can be formed on the peripheral flange portion 304, whilst a mask with a shape conforming to the central protruding portion 302 is used to cover the central protruding portion 302 to protect the central protruding portion 302 from having the multilayer film 312 formed thereon. Of course, the multilayer film 312 can be formed on the central protruding portion 302 and on the peripheral flange portion 304 synchronously without the mask. Thus, the central protruding portion 302 can be entirely covered by the multilayer film 312 and protected from corrosion and abrasion.

The core insert 100, the core insert 200 and the core insert 300 made by means of the above-described methods have excellent hardness, good corrosion resistance, good wear resistance, high adhesion and long operational lifetime.

While certain embodiments of the present invention have been described and exemplified above, various other embodiments will be apparent to those skilled in the art from the foregoing disclosure. The present invention is, therefore, not limited to the particular embodiments described and exemplified but is capable of considerable variation and modification without departure from the scope of the appended claims.

What is claimed is:

1. A core insert, comprising:

a main body comprising a central protruding portion and a peripheral flange portion surrounding the central protruding portion, and a multilayer film formed on the central protruding portion, the multilayer film comprising a nickel-phosphorus layer formed on the central protruding portion, a chromium layer formed on the nickel-phosphorus layer, a chromium nitride layer formed on the chromium layer, and a diamond-like carbon layer formed on the chromium nitride layer.

2. The core insert as claimed in claim 1, wherein the multilayer film is formed on the peripheral flange portion.

3. The core insert as claimed in claim 2, wherein the central protruding portion is entirely covered by the multilayer film.

4. The core insert as claimed in claim 1, wherein the peripheral flange portion has a plurality of grooves defined therein.

5. The core insert as chimed in claim 1, wherein the main body is comprised of a material selected from a group consisting of iron-carbon-chromium alloy, iron-carbon-chromium-molybdenum alloy, iron-carbon-chromium-silicon alloy, iron-carbon-chromium-molybdenum alloy, iron-carbon-chromium-nickel-titanium alloy, iron-carbon-chromium-tungsten-manganese alloy, iron-carbon-chromium-tungsten-vanadium alloy, iron-carbon-chromium-molybdenum-vanadium alloy, and iron-carbon-chromium-molybdenum-vanadium-silicon alloy.

6. The core insert as claimed in claim 1, wherein the nickel-phosphorus layer has a thickness in a range from 1 micron to 30 microns.

7. The core insert as claimed in claim 6, wherein the nickel-phosphorus layer has a thickness in a range from 5 microns to 20 microns.

8. The core insert as claimed in claim 1, wherein the chromium layer has a thickness in a range from 50 nanometers to 500 nanometers.

9. The core insert as claimed in claim 8, wherein the chromium layer has a thickness in a range from 100 nanometers to 300 nanometers.

10. The core insert as claimed in claim 1, wherein the chromium nitride layer has a thickness in a range from 100 nanometers to 2000 nanometers.

11. The core insert as claimed in claim 10, wherein the chromium nitride layer has a thickness in a range from 500 nanometers to 1500 nanometers.

12. The core insert as claimed in claim 1, wherein the diamond-like carbon layer has a thickness in a range from 100 nanometers to 3000 nanometers.

13. A method for manufacturing a core insert, comprising the steps of:

providing a main body comprising a central protruding portion and a peripheral flange portion surrounding the central protruding portion;

forming a nickel-phosphorus layer on the central protruding portion;

forming a chromium layer on the nickel-phosphorus layer;

forming a chromium nitride layer on the chromium layer; and forming a diamond-like carbon layer on the chromium nitride layer.

14. The method as claimed in claim 13, wherein the nickel-phosphorus layer is formed using an electroless plating process.

15. The method as claimed in claim 13, wherein the chromium layer, the chromium nitride layer and the diamond-like carbon layer are formed using a sputtering deposition process.

16. The method as claimed in claim 13, wherein the nickel-phosphorus layer is formed on the peripheral flange portion.

17. The method as claimed in claim 13, further comprising a step of forming a plurality of grooves in the peripheral flange portion.

18. A core insert, comprising:

a main body comprising a central protruding portion and a peripheral flange portion surrounding the central protruding portion, and a multilayer film formed on the central protruding portion, the multilayer film comprising a nickel-phosphorus layer formed on the central protruding portion, a chromium layer formed on the nickel-phosphorus layer, a chromium nitride layer formed on the chromium layer, and an amorphous hydrogenated carbon layer formed on the chromium nitride layer.

19. The core insert as claimed in claim 18, wherein the central protruding portion is integrally formed with the peripheral flange portion.

20. The core insert as claimed in claim 18, wherein a plurality of grooves are defined in a surface of the peripheral flange portion that adjoins the central protruding portion.

* * * * *